US011911646B2

(12) United States Patent
Singer

(10) Patent No.: US 11,911,646 B2
(45) Date of Patent: Feb. 27, 2024

(54) EXERCISE MACHINE

(71) Applicant: De Luna Studios, LLC, Lyons, CO (US)

(72) Inventor: Sarah Elizabeth Singer, Lyons, CO (US)

(73) Assignee: De Luna Studios, LLC, Lyons, CO (US)

( * ) Notice: Subject to any disclaimer, the term of this patent is extended or adjusted under 35 U.S.C. 154(b) by 0 days.

(21) Appl. No.: 17/170,257

(22) Filed: Feb. 8, 2021

(65) Prior Publication Data

US 2021/0244993 A1 Aug. 12, 2021

Related U.S. Application Data

(60) Provisional application No. 62/972,476, filed on Feb. 10, 2020.

(51) Int. Cl.

| | |
|---|---|
| ***A63B 21/04*** | (2006.01) |
| ***A63B 21/00*** | (2006.01) |
| ***A63B 5/11*** | (2006.01) |
| ***A63B 22/00*** | (2006.01) |

(52) U.S. Cl.

CPC ..... *A63B 21/0428* (2013.01); *A63B 5/11* (2013.01); *A63B 21/154* (2013.01); *A63B 21/4045* (2015.10); *A63B 21/4047* (2015.10); *A63B 22/0087* (2013.01); *A63B 22/0089* (2013.01)

(58) Field of Classification Search

CPC ..... A63B 21/00065; A63B 21/0442; A63B 21/4035; A63B 21/4033; A63B 21/055; A63B 21/0552; A63B 21/4029; A63B 21/4034; A63B 21/4045–4049; A63B 21/4037; A63B 21/4041; A63B 22/0087; A63B 22/20–208; A63B 23/03525; A63B 23/03575; A63B 23/0405; A63B 23/12; A63B 2023/0411; A63B 2208/0204; A63B 2208/0228; A63B 2208/0247; A63B 2208/0252; A63B 2208/0257; A63B 2210/50; A63B 2022/206

See application file for complete search history.

(56) References Cited

U.S. PATENT DOCUMENTS

| | | | | |
|---|---|---|---|---|
| 3,892,404 A * | 7/1975 | Martucci | ..... | A63B 21/0622 482/145 |
| 4,506,884 A | 3/1985 | Hankin | | |
| 5,342,266 A | 8/1994 | Dailey | | |
| 5,681,249 A * | 10/1997 | Endelman | ..... | A63B 21/154 482/133 |

(Continued)

OTHER PUBLICATIONS

Pilates ProWorks—FitFormer; https://www.pilatesproworks.com/fitformer; downloaded on Feb. 1, 2021—(5) pages.

(Continued)

*Primary Examiner* — Loan B Jimenez
*Assistant Examiner* — Kathleen M Fisk
(74) *Attorney, Agent, or Firm* — Boyle Fredrickson, S.C.

(57) ABSTRACT

An exercise machine that incorporates the design of the Pilates reformer with more current pieces of exercise equipment and options for a more versatile workout such as the use of a rotatable carriage that can rotate perpendicular to the frame to enable a user to perform supine exercises, the use of a trampoline and the use of a moving foot bar.

8 Claims, 17 Drawing Sheets

(56) References Cited

U.S. PATENT DOCUMENTS 6,186,929 B1 2/2001 Endelman et al.
6,338,704 B1 1/2002 Endelman
6,371,895 B1 4/2002 Endelman et al.
6,527,685 B2 3/2003 Endelman et al.
6,685,606 B2 2/2004 Endelman
6,916,279 B2 7/2005 Endelman
6,926,650 B2 * 8/2005 Endelman ..... A63B 22/0087 482/121
6,971,976 B2 12/2005 Endelman et al.
7,125,368 B2 10/2006 Endelman
7,125,369 B2 10/2006 Endelman
7,160,232 B2 1/2007 Barnard et al.
7,163,500 B2 1/2007 Endelman et al.
7,288,053 B2 * 10/2007 Endelman ..... A63B 23/035 482/121
7,288,054 B2 10/2007 Endelman et al.
7,294,098 B2 11/2007 Barnard et al.
7,452,313 B2 11/2008 Endelman
7,465,261 B2 12/2008 Barnard et al.
7,563,217 B2 7/2009 Endelman
7,604,579 B2 10/2009 Isacowitz et al.
7,691,039 B2 4/2010 Isacowitz et al.
D622,787 S 8/2010 Masterson et al.
D623,244 S 9/2010 Hoffman
7,833,139 B1 11/2010 Endelman et al.
7,931,570 B2 4/2011 Hoffman
8,016,210 B2 9/2011 Wright
8,088,045 B2 1/2012 Hoffman
8,157,714 B2 4/2012 Mayr
D659,205 S 5/2012 Endelman et al.
D659,206 S 5/2012 Oberwelz et al.
D659,208 S 5/2012 Savarino et al.
8,221,293 B2 7/2012 Hoffman et al.
RE43,981 E 2/2013 Endelman
8,435,163 B2 5/2013 Uygan
8,500,611 B2 8/2013 Hoffman
8,579,773 B2 11/2013 Uygan
8,602,950 B2 12/2013 Savarino
8,602,953 B2 12/2013 Jordan
8,641,585 B2 * 2/2014 LaGree ..... A63B 22/203 482/92
8,663,074 B2 3/2014 Uygan
8,715,146 B2 5/2014 Bronston et al.
8,721,005 B2 5/2014 Mankin
8,721,511 B2 5/2014 Endelman et al.
8,870,294 B2 10/2014 Mankin
8,888,661 B2 * 11/2014 Ellis ..... A63B 22/205 482/96
8,915,829 B2 12/2014 Endelman et al.
9,132,310 B2 9/2015 Masterson et al.
9,132,311 B2 9/2015 Masterson et al.
9,254,407 B2 2/2016 Savarino
9,265,985 B2 2/2016 Uygan
9,289,645 B2 3/2016 Masterson et al.
9,393,459 B2 7/2016 Savarino
9,421,683 B2 8/2016 Savarino
9,517,375 B2 12/2016 Lagree
9,522,299 B2 12/2016 Lagree
9,526,937 B2 12/2016 Uygan
9,533,184 B1 1/2017 Lagree et al.
9,533,185 B1 1/2017 Lagree
9,545,535 B2 1/2017 Lagree
9,555,282 B1 1/2017 Lagree
9,579,536 B1 2/2017 Lagree
9,579,555 B2 2/2017 Lagree
9,586,081 B2 3/2017 Lagree et al.
9,597,545 B1 3/2017 Lagree
9,604,095 B1 3/2017 Lagree et al.
9,604,097 B1 3/2017 Lagree
D789,463 S 6/2017 Lagree et al.
9,700,754 B2 7/2017 Lagree
9,717,945 B2 8/2017 Lagree
9,744,395 B1 8/2017 Lagree et al.
9,776,043 B2 10/2017 Lagree
9,776,062 B2 10/2017 Lagree
9,789,354 B2 10/2017 Lagree et al.
9,808,664 B2 11/2017 Lagree
9,849,330 B2 12/2017 Lagree
9,868,009 B2 1/2018 Lagree et al.
9,868,010 B2 1/2018 Lagree et al.
9,868,011 B2 1/2018 Lagree
9,868,018 B2 1/2018 Lagree
9,868,019 B2 1/2018 Lagree et al.
9,914,014 B2 3/2018 Lagree et al.
RE46,803 E 4/2018 Bronston et al.
9,962,573 B2 5/2018 Lagree et al.
9,962,592 B2 5/2018 Lagree
9,981,156 B2 5/2018 Lagree
10,010,738 B2 * 7/2018 Gerschefske ..... A63B 23/0405
10,016,655 B2 7/2018 Lagree
10,022,577 B2 7/2018 Lagree et al.
10,022,581 B2 7/2018 Lagree
10,029,141 B2 7/2018 Lagree
10,046,193 B1 * 8/2018 Aronson ..... A63B 21/0407
10,052,518 B2 8/2018 Lagree
10,065,069 B1 9/2018 Lagree et al.
10,109,216 B2 10/2018 Lagree
10,118,067 B2 11/2018 Lagree et al.
10,124,232 B2 11/2018 Lagree
10,143,882 B2 12/2018 Lagree
10,150,003 B2 12/2018 Lagree
10,155,129 B2 12/2018 Lagree et al.
10,201,724 B2 2/2019 Lagree
10,213,641 B2 2/2019 Lagree
10,220,244 B2 3/2019 Lagree
10,238,910 B2 3/2019 Lagree et al.
10,245,462 B2 4/2019 Endelman
10,265,573 B2 4/2019 Lagree et al.
10,265,583 B1 4/2019 Zaffino
10,272,285 B2 4/2019 Lagree et al.
10,279,207 B2 5/2019 Lagree
10,300,328 B2 5/2019 Lagree et al.
10,369,398 B2 8/2019 Lagree et al.
D863,471 S 10/2019 Endelman
D863,472 S 10/2019 Endelman
10,449,405 B2 10/2019 Endelman et al.
10,478,656 B2 11/2019 Lagree et al.
10,478,663 B2 11/2019 Lagree et al.
10,486,017 B1 11/2019 Lagree et al.
10,493,321 B2 12/2019 Lagree et al.
10,500,441 B2 12/2019 Lagree
10,518,127 B2 12/2019 Lagree et al.
10,549,140 B2 2/2020 Lagree et al.
10,561,896 B2 2/2020 Lagree et al.
10,569,118 B2 2/2020 Lagree et al.
10,569,119 B2 2/2020 Endelman et al.
10,603,546 B1 3/2020 Lagree et al.
10,610,723 B2 4/2020 Endelman et al.
10,695,645 B1 6/2020 Lagree
10,702,730 B2 7/2020 Lagree et al.
10,702,760 B2 7/2020 Lagree et al.
10,716,964 B1 7/2020 Lagree et al.
10,744,370 B1 8/2020 Lagree
10,751,600 B2 8/2020 Lagree et al.
10,758,772 B2 9/2020 Endelman
10,780,307 B2 9/2020 Lagree et al.
D899,536 S 10/2020 Endelman
10,792,528 B1 10/2020 Lagree et al.
10,792,538 B2 10/2020 Lagree
10,820,698 B2 11/2020 Endelman et al.
10,835,775 B1 11/2020 Lagree et al.
10,850,155 B2 12/2020 Lagree
10,850,158 B2 12/2020 Lagree et al.
10,857,418 B2 12/2020 Lagree et al.
10,857,420 B2 12/2020 Lagree
10,864,399 B2 12/2020 Lagree et al.
10,870,034 B2 12/2020 Lagree et al.
10,881,896 B2 1/2021 Lagree et al.
2005/0101462 A1 * 5/2005 Atwell ..... A63B 21/4031 482/142
2005/0245367 A1 11/2005 Horvath
2014/0194260 A1 * 7/2014 Campanaro ..... A63B 21/0628 482/131

(56) References Cited

U.S. PATENT DOCUMENTS

| | | | | |
|---|---|---|---|---|
| 2015/0202484 | A1* | 7/2015 | Lalaoua | A63B 23/0211 482/130 |
| 2018/0117388 | A1* | 5/2018 | Porter | A63B 21/00069 |
| 2019/0160325 | A1 | 5/2019 | Latronica et al. | |
| 2020/0188737 | A1* | 6/2020 | Villency | A63B 21/4034 |

OTHER PUBLICATIONS

Flex Studios Flexformer; https://flexstudios.com/; downloaded on Feb. 1, 2021—(2) pages.

Partial European Search Report dated Jul. 8, 2021; Application / Patent No. 21155934.9-1122—(12) pages.

* cited by examiner

EXERCISE MACHINE

CROSS-REFERENCE TO RELATED APPLICATIONS

This application claims priority to U.S. Provisional Application Ser. No. 62/972,476, filed Feb. 10, 2020, the entire contents of which is incorporated herein by reference.

BACKGROUND OF THE INVENTION

The Pilates reformer is an exercise machine incorporating the Pilates exercise technique for a challenging and an intense workout. Springs, leverage, and body weight are used as resistance while performing movements targeting specific muscle groups. Workouts consist of controlled, flowing movements working muscles through a full range of motion. The reformer adds increased resistance to the movement. By working to overcome this resistance, training results in increased fitness levels.

The design of the Pilates reformer has changed over the years as have the types of exercises and exercise equipment used. There is a need for an exercise machine that incorporates the design of the Pilates reformer with more current pieces of exercise equipment and options for a more versatile workout.

SUMMARY OF THE INVENTION

In one aspect of the invention, an exercise machine includes a frame having rails defining a longitudinal axis and a carriage attached to the frame with springs, moveable along the rails in a first direction parallel to longitudinal axis and moveable in a second direction that is non-parallel to the longitudinal axis.

In another aspect of the invention, an exercise machine includes a frame having rails defining a longitudinal axis, a carriage attached to the frame with springs, moveable along the rails in a first direction parallel to longitudinal axis and moveable in a second direction that is non-parallel to the longitudinal axis, a trampoline pad moveable between a vertical position above the frame and a horizontal position extending outwardly from the frame; a foot bar moveable and securely positionable along a plurality of positions along the frame; a handle bar and a pulley having a first position attached to the handle bar and a second position attached to the frame.

In another aspect of the invention, an exercise machine includes a frame having rails, a carriage attached to the frame with springs and having a top surface, a head rest on the carriage having a first position non-planar with the top surface of the carriage and movable to a second position generally planar with the top surface of the carriage, a shoulder rest on the carriage having a first position non-planar with the top surface of the carriage and movable to a second position generally planar with the top surface of the carriage and a mat conversion pad having a top surface and removably positionable on the frame such that the top surface of the pad and the top surface of the carriage are adjacent forming a unified planar area when the head rest and shoulder rest are in their respective second positions.

Figure 1:
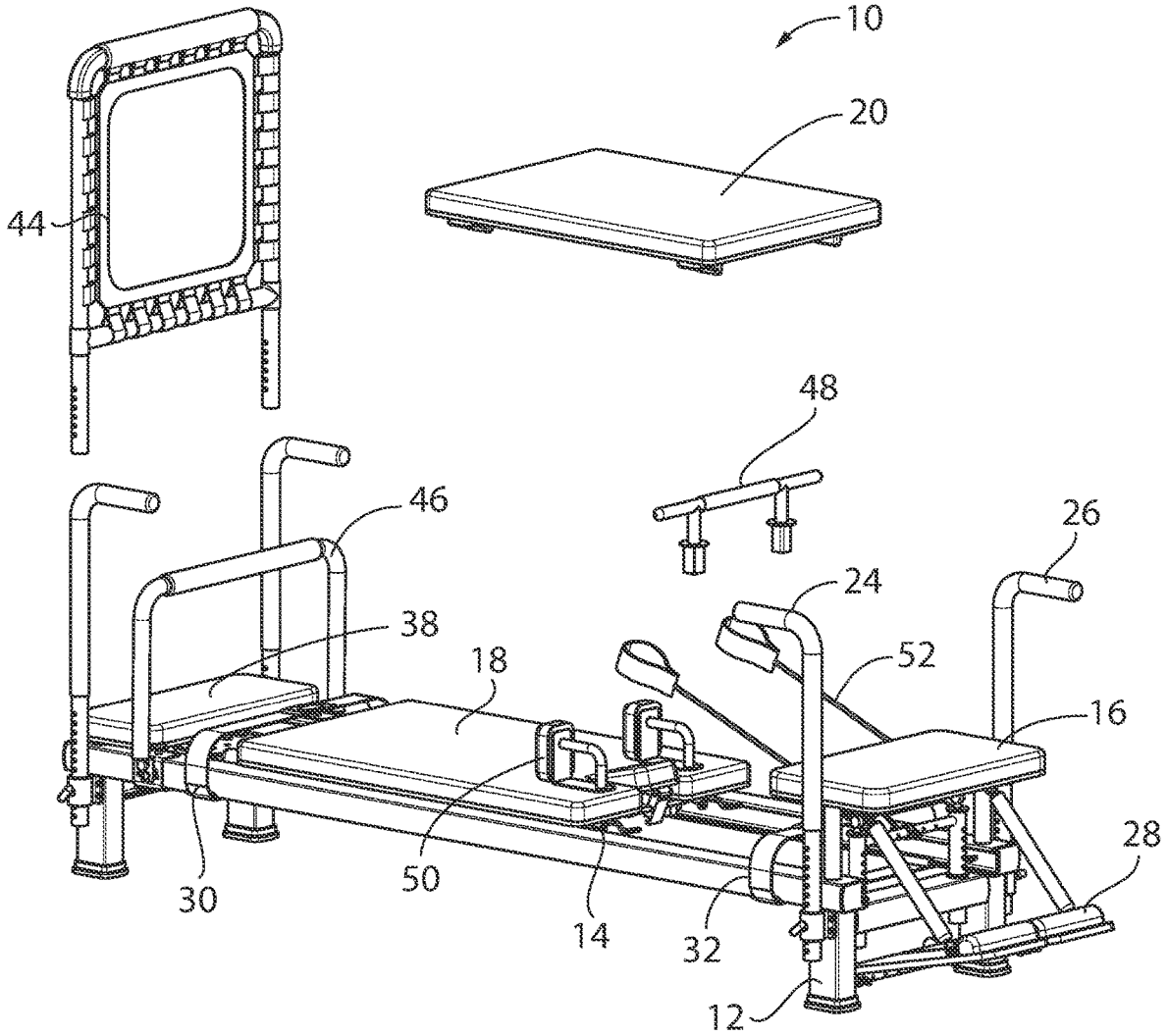
FIG. 1 is an exploded view of an exercise machine of the present invention.
Figure 2:
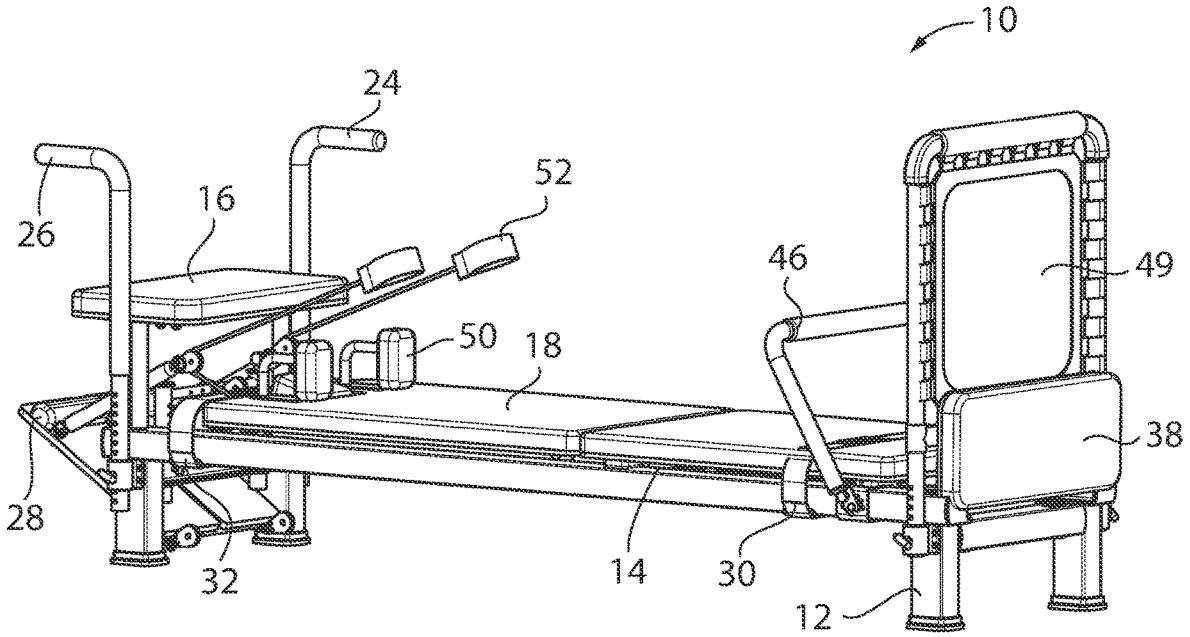
FIG. 2 is a perspective view of the exercise machine.
Figure 3:
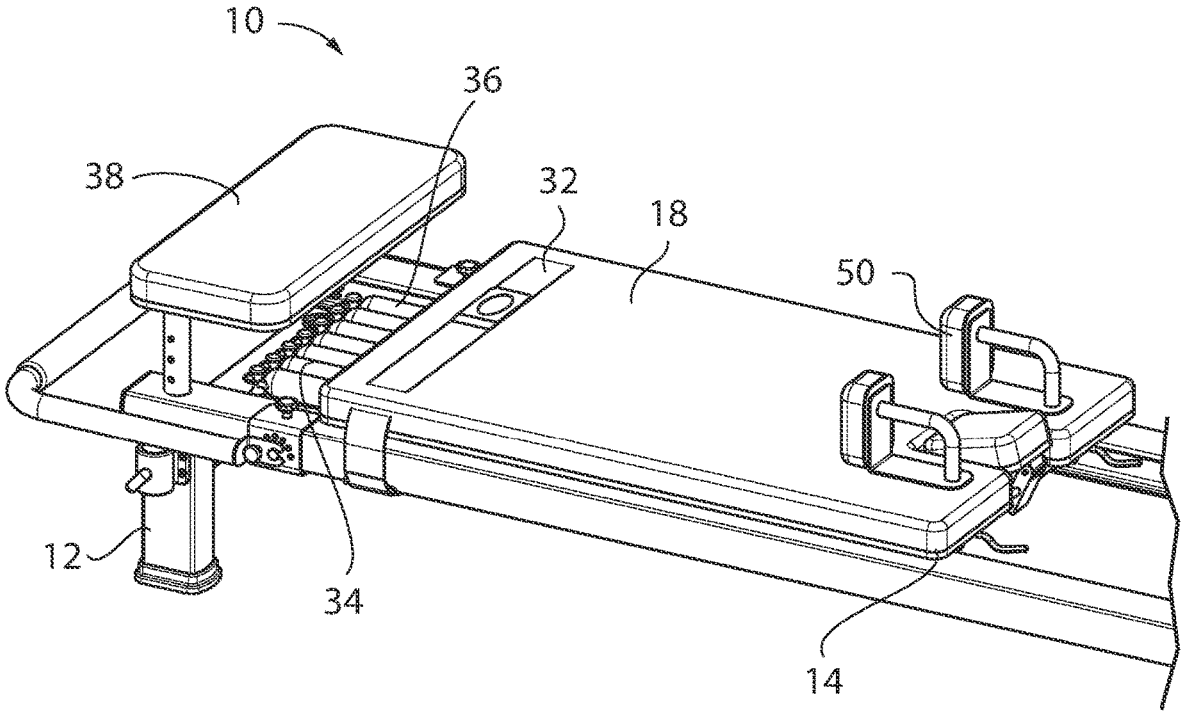
FIG. 3 is a partial perspective view of one end of the exercise machine.
Figure 4:
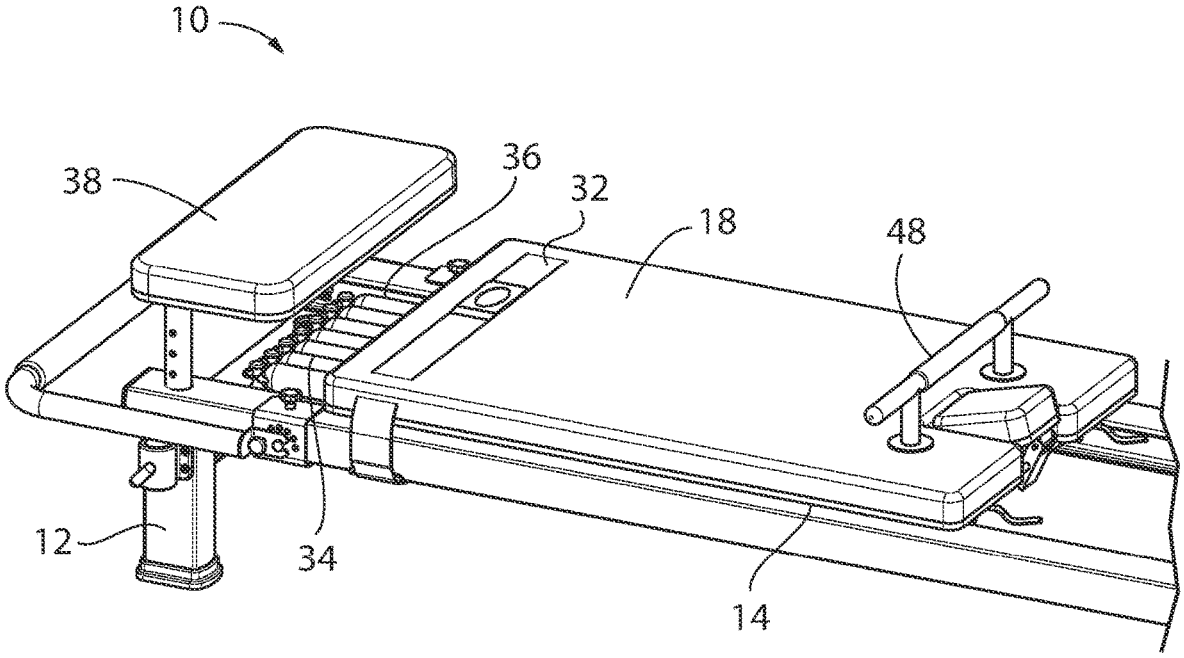
FIG. 4 is a partial perspective view of one end of the exercise machine in an alternate configuration.
Figure 5:
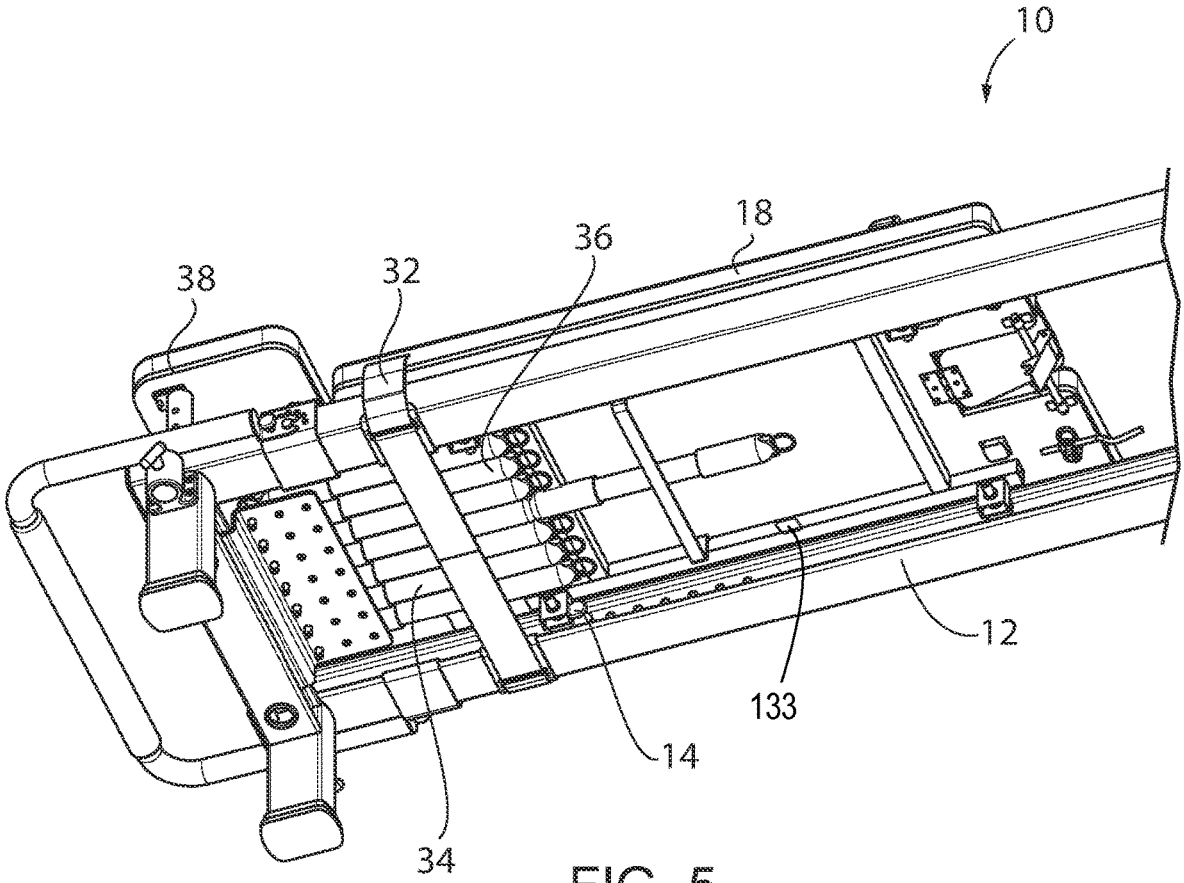
FIG. 5 is a partial perspective view of the underside of the exercise machine.
Figure 6:
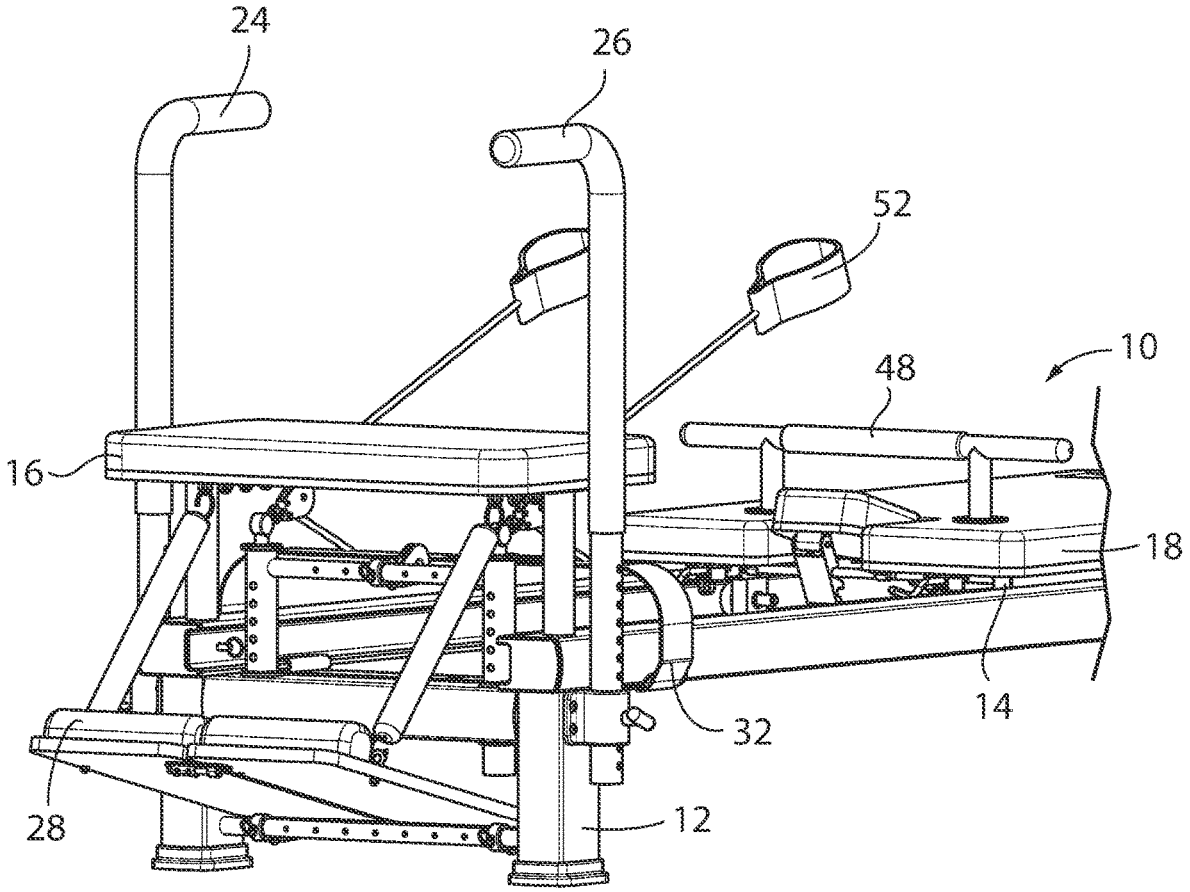
FIG. 6 is a partial perspective view of a chair end of the exercise machine.
Figure 7:
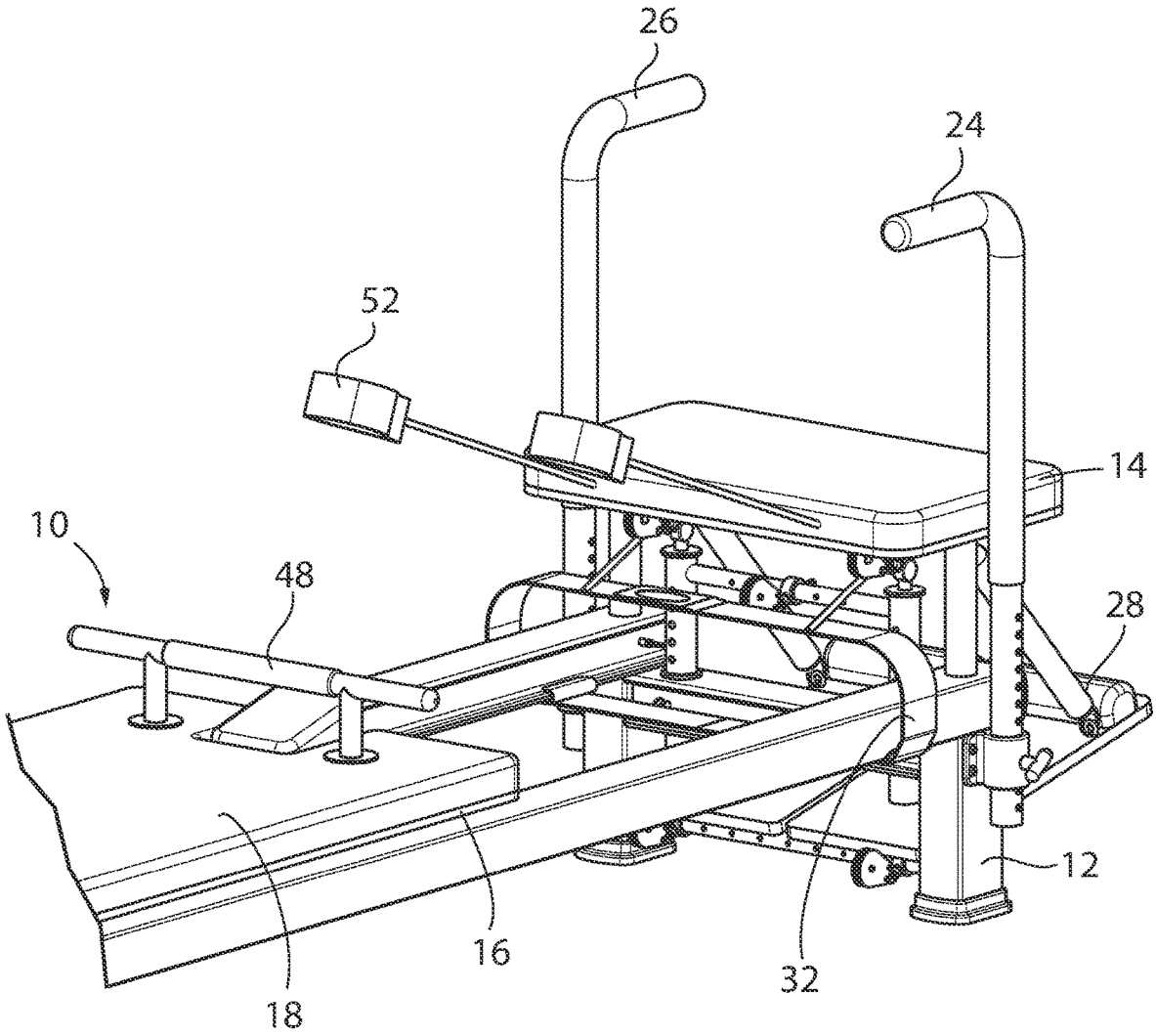
FIG. 7 is a partial perspective view of the chair end of the exercise machine.
Figure 8:
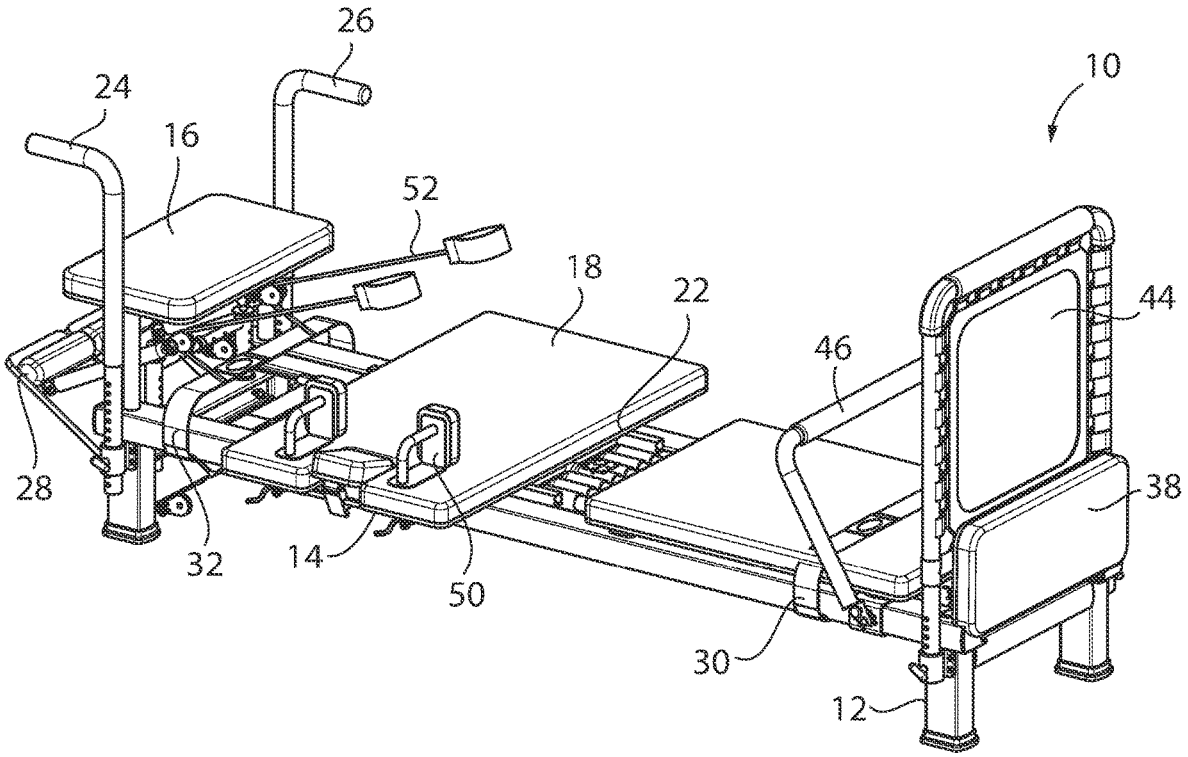
FIG. 8 is a perspective view of exercise machine in an alternative rotated position.

Before any embodiments of the invention are explained in detail, it is to be understood that the invention is not limited in its application to the details of constructions and the arrangement of components set forth in the following description or illustrated in the drawings. The invention is capable of other embodiments and of being practiced or of being carried out in various ways.

DETAILED DESCRIPTION OF THE INVENTION

Referring to FIGS. 1-8, there is shown an exercise machine 10 of the present invention. Preferably, the exercise machine 10 is intended for home use or for studio space but other uses, such as in training studios, are also contemplated. The exercise machine 10 enables Pilates, yoga, ballet bar, low impact workouts and similar applications and fitness styles.

The exercise machine 10 is designed to allow the user to seamlessly move from one exercise to the next for improved user workout efficiency and for enabling classes of users to move along seamlessly. The exercise machine 10 is designed for the demands of commercial fitness and thus can handle over-use and extreme heat.

The exercise machine 10 includes a frame 12, a carriage 14 and a chair 16 in one integrated piece of equipment. The exercise machine 10 optionally includes wheels (not shown) to make the exercise machine 10 easy to move. Preferably, all hardware is covered for a streamlined look to the exercise machine 10.

The carriage 14 is axially moveable along the frame 12 as is known in the art. The carriage 14 includes a carriage pad 18 dimensioned to be longer and wider than a traditional reformer so as to accommodate taller and bigger users, to be more ergonomic to users, and to allow other exercises such as mat Pilates and yoga to be performed on the carriage pad 18. A secondary mat 20 can be utilized on top of the carriage pad 18.

The carriage 14 includes a rotating mechanism 22 so that the carriage pad 18 can rotate perpendicular to the frame 12 for added supine exercises for example. The carriage 14 can optionally split in half so that users can do unilateral movements and standing exercise.

The carriage 14 includes handles 24 and 26 to add more options for user hand positioning. The handles 24 and 26 are used with the chair 16 for traditional chair exercises and can also be rotated and use while on the carriage 14. The handles 24 and 26 are used for plank exercises with the carriage 14 being used for added resistance.

The chair 16 is utilized as a traditional Pilates chair. The chair 16 includes chair pedals 28.

A foot strap 30 is connected to the interior of the frame to be utilized as a foot strap such as in standing or lunging exercises.

A carriage straps 32 on the carriage 14 is used for additional exercises such as plank work and positioned on one end of the carriage 14. The strap 32 is connected to a pulley (not shown) and can be easily unclipped to be moved to the lower junction allowing more versatility with exercises. The pulley is provided to give the option to have resistance from below as well as the more traditional location above the carriage pad 18.

An enhanced spring system 34 is incorporated into the exercise machine 10. The spring system 34 is utilized for traditional Pilates exercises as well as for the additional formats of exercise. The spring system 34 includes seven color coded springs 36 to add weight and more options to the exercise machine 10.

A platform 38 is utilized for kneeling exercises facing the opposite direction. The platform 38 utilizes the springs 36 in an alternate way than traditional kneeling exercises. The platform 38 can be rotated to a storage position.

To enhance the exercise machine, a trampoline pad 44 is included and is preferably positioned upright. Alternately and not shown, the trampoline pad 44 can be folded and stowed under the frame 12. The trampoline pad 44 can be used while the user is lying supine or standing in front of the carriage 14.

A moving foot bar 46 is included on one end of the exercise machine 10. The foot bar 46 is moveable along the length of the frame 12. The foot bar 46 is detachable from the exercise machine 10.

An optional bar 48 and shoulder rest 50 are attached to the carriage 14 as well as handle/foot straps 52.

The exercise machine 10 can also be paired with programming as well as an app, not shown, that allow the user to stream classes using the exercise machine 10.

Figure 9:
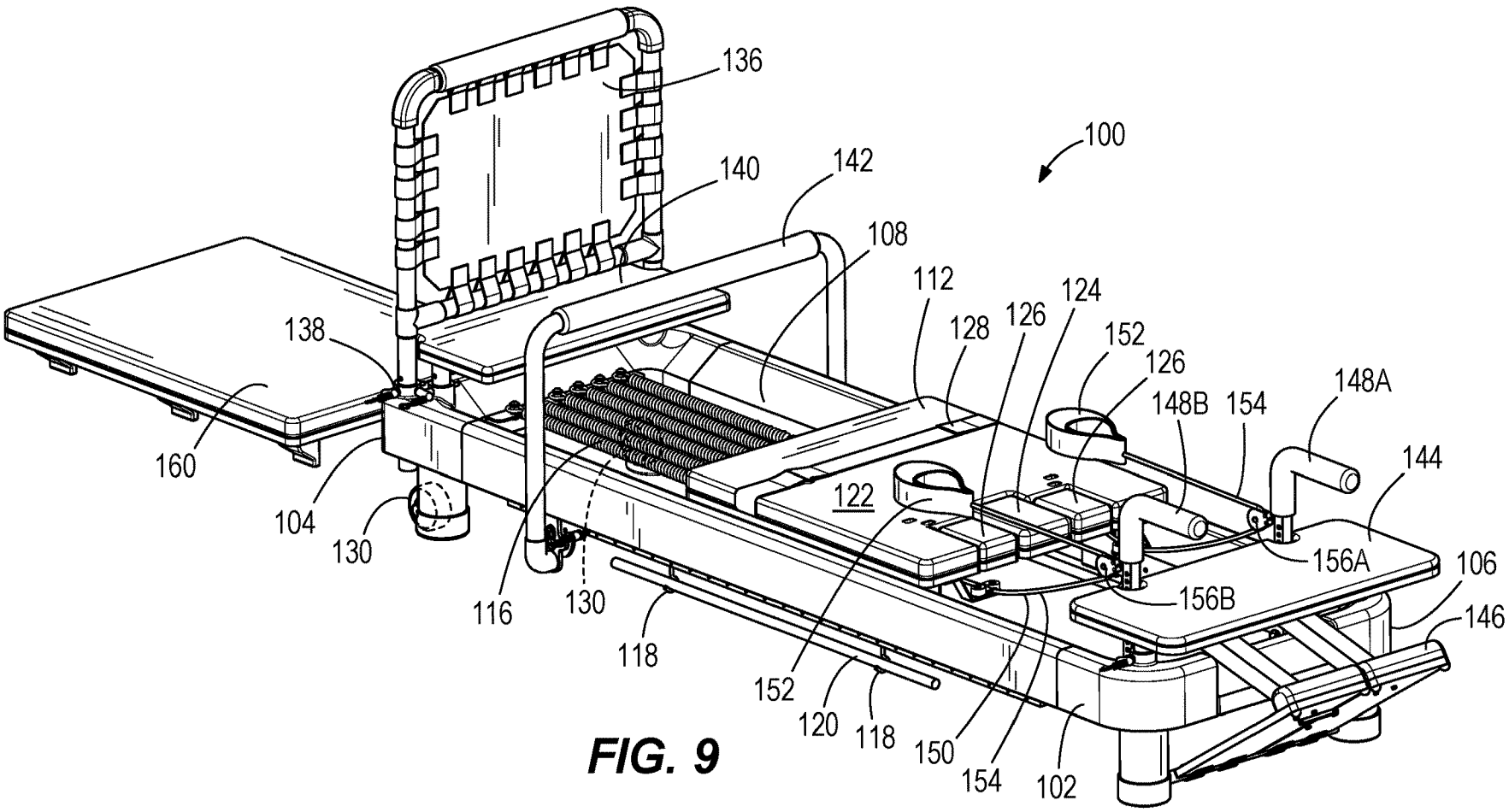
FIG. 9 is a perspective view of a second embodiment of an exercise machine.

Turning now to a second embodiment of the exercise machine as shown in FIG. 9, the exercise machine 100 is designed for a full body workout incorporating the ability to perform many more exercises than traditional Pilates reformer-type exercises. The exercise machine 100 is particularly adapted for home use such that it accommodates a wide variety of potential exercises with one piece of equipment that a home user is looking for. It should be noted, however, the exercise machine 100 can be used in a gym-type setting as well.

Figure 10:
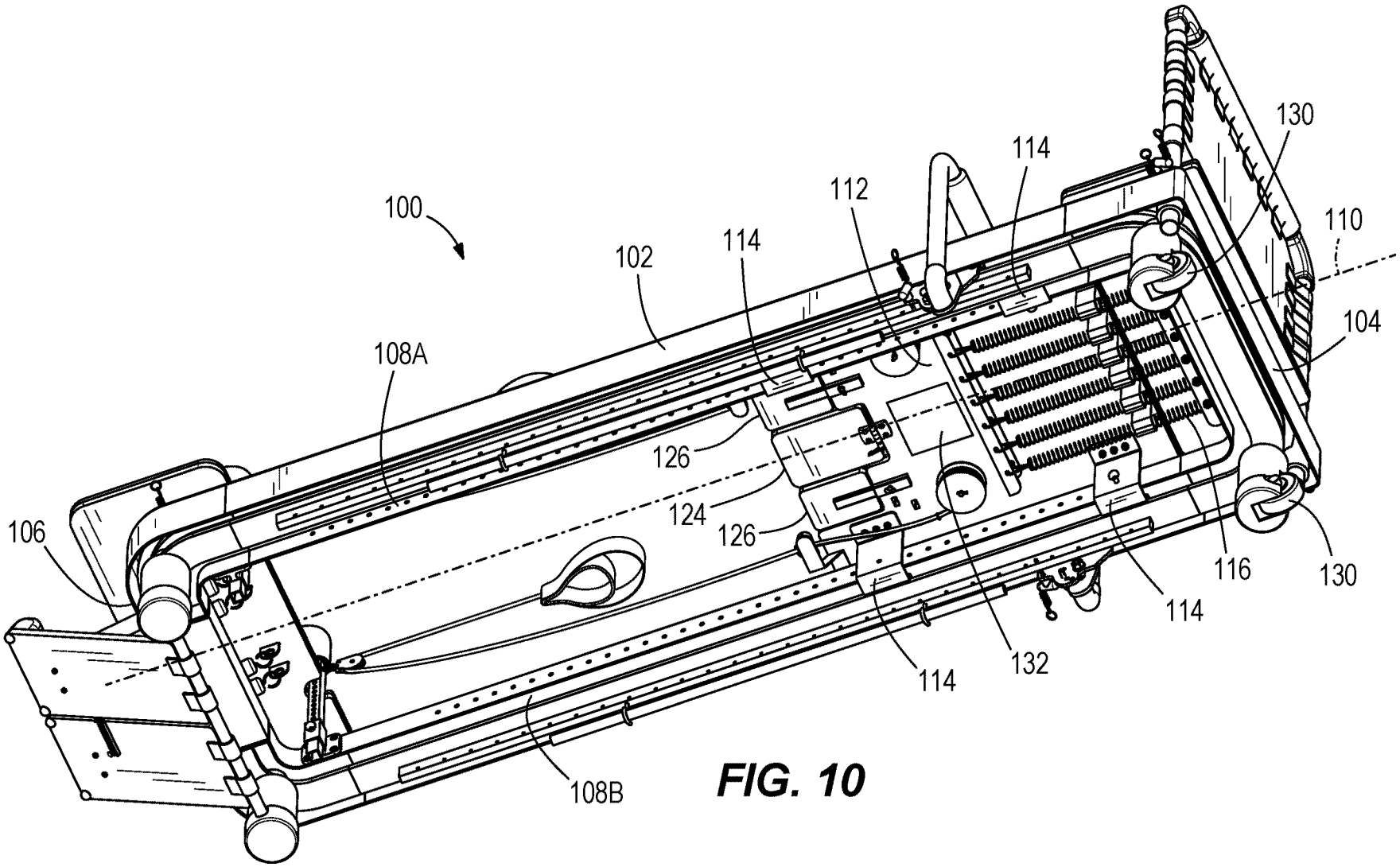
FIG. 10 is a perspective view of the underside of the exercise machine.

As shown in FIGS. 9 and 10, the exercise machine 100 includes a frame 102 that is generally rectangular with a front end 104, a rear end 106 and pair of rail members 108A and 108B, extending between the front end 104 and rear end 106, that define a longitudinal axis 110. A carriage 112 rides on the rails 108A and 108B using wheel assemblies 114 so as to be linearly slidable along the rails 108A and 108B in a direction parallel to the longitudinal axis 110 as is known in the art. The carriage 112 is movably secured to the frame 102 via a plurality of springs 116 that are selectively connectable to the carriage 112 to bias the carriage 112 and to provide resistance and stability to the carriage 112 as is known in the art. As shown, there are six springs 116, however, differing number of springs can also be utilized. The frame 102 includes two hooks 118 to support a dowel 120. A user can remove the dowel 120 from the hooks 118 for use while exercising. The carriage 112 is capable of being removed from the frame 102 such as sliding off the rails on end 104 or 106 as is known in the art.

Figure 11:
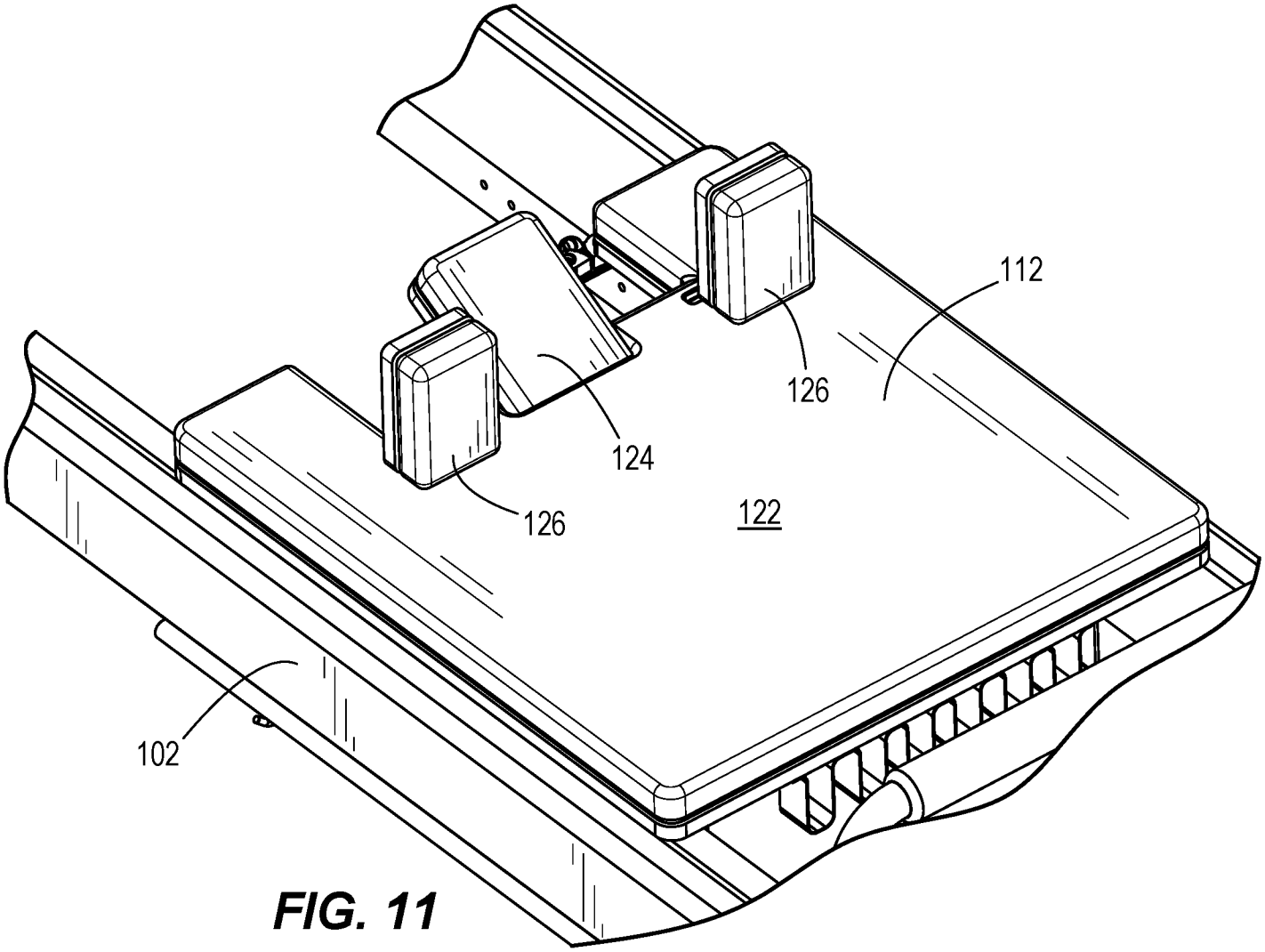
FIG. 11 is a partial perspective view of the exercise machine particularly showing the carriage.

Referring to FIGS. 9 and 11, the carriage 112 includes a top surface 122 upon which the user can support themselves that is generally rectangular. The carriage 112 includes a head rest 124 having a stowed position that is generally planar with the remainder of the top surface 122 of the carriage 112 as shown in FIG. 9 and a deployed position to support a user's head during use of the exercise machine 100 if desired as shown in FIG. 11. To move from the stowed position to the deployed position, the head rest 124 preferably slides and rotates, however, other types of motion can also be used.

Continuing to refer to FIGS. 9 and 11, the carriage 112 includes at least one shoulder rest 126 such as the two shoulder rests shown. Each shoulder rest 126 has a stowed position that is generally planar with the remainder of the top surface 122 of the carriage 112 as shown in FIG. 9 and a deployed position to support a user's shoulders during use of the exercise machine 100 if desired as shown in FIG. 11. To move from the stowed position to the deployed position, the shoulder rest 126 preferably slides and rotates, however, other types of motion can also be used.

As shown in FIG. 9, optionally the carriage 112 includes afoot strap 128 under which a user can tuck a foot or feet for stability. Optionally, the carriage 112 can include wheels 130. Preferably, the wheels 130 are secured to the frame 102 at the front end 104 for ease of repositing the exercise machine 100 if needed.

Figure 12:
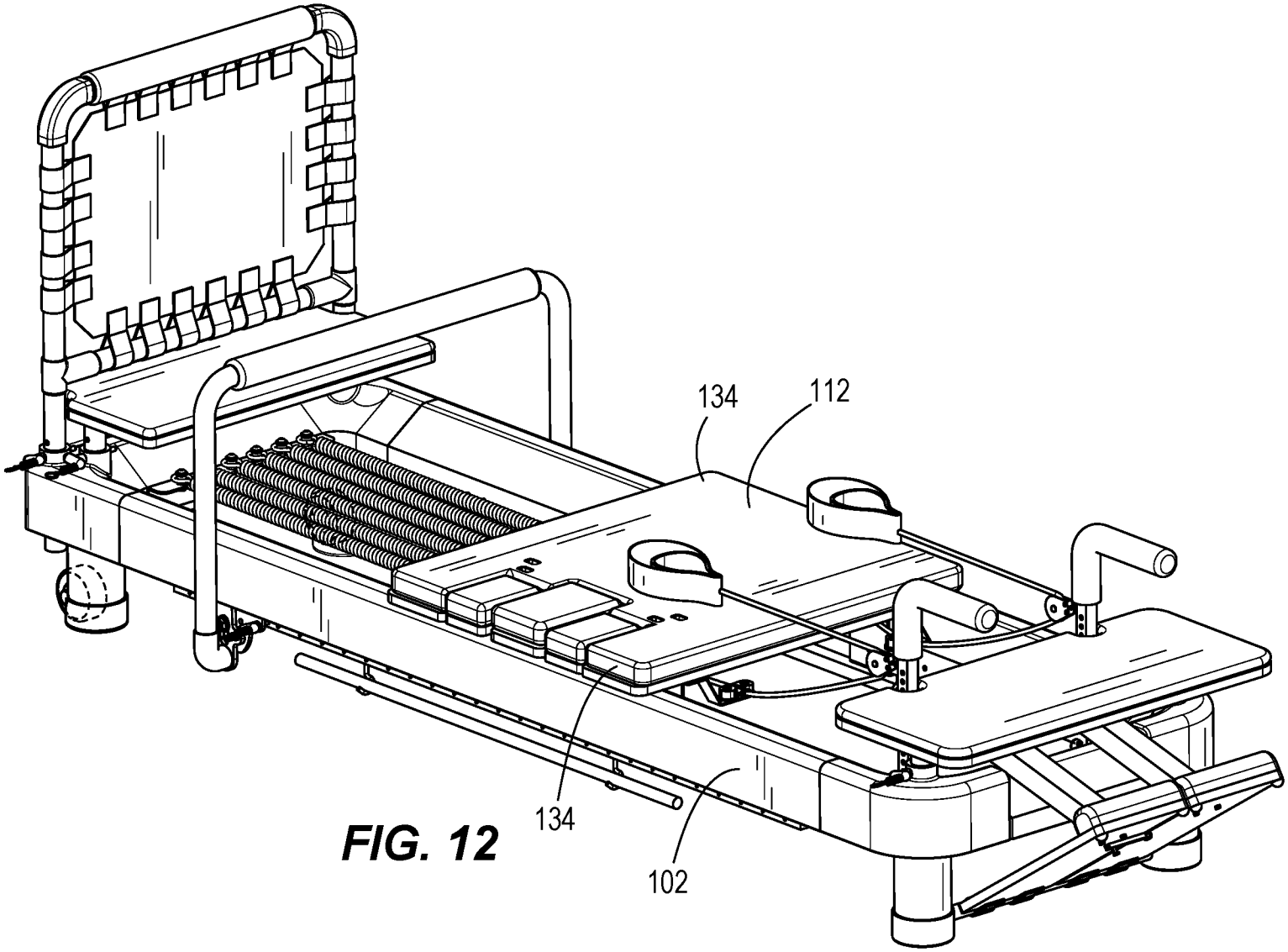
FIG. 12 is a perspective view of the exercise machine with the carriage in a different orientation relative to the frame.

With reference to FIGS. 9 and 12, the carriage 112 is also capable of movement in addition to sliding along the rails 108A and 108B in a direction parallel to the longitudinal axis 110. Specifically, the carriage 112 is also capable of moving in a second direction that is not parallel to the longitudinal axis 110. Specifically, in one embodiment, the carriage 112 is rotatable using a rotation mechanism 132 on the frame 102 to swivel the carriage 112 to a second position, such as the second position shown in FIG. 12 where the carriage 112 is in a position 90 degrees from its sliding position of FIG. 9. In the second position, a user is able to use the portion 134 of the carriage 112 extending beyond the rails 108A and 108B as a platform for differing exercises instead of using a separate Pilates box. The rotation mechanism 132 can also lock the carriage in the second position, however, a separate lock 133 (FIG. 5) could also be utilized. It should also be noted that the carriage 112 can be moved in a second direction other than the rotational angular movement shown in FIG. 12.

Figure 13:
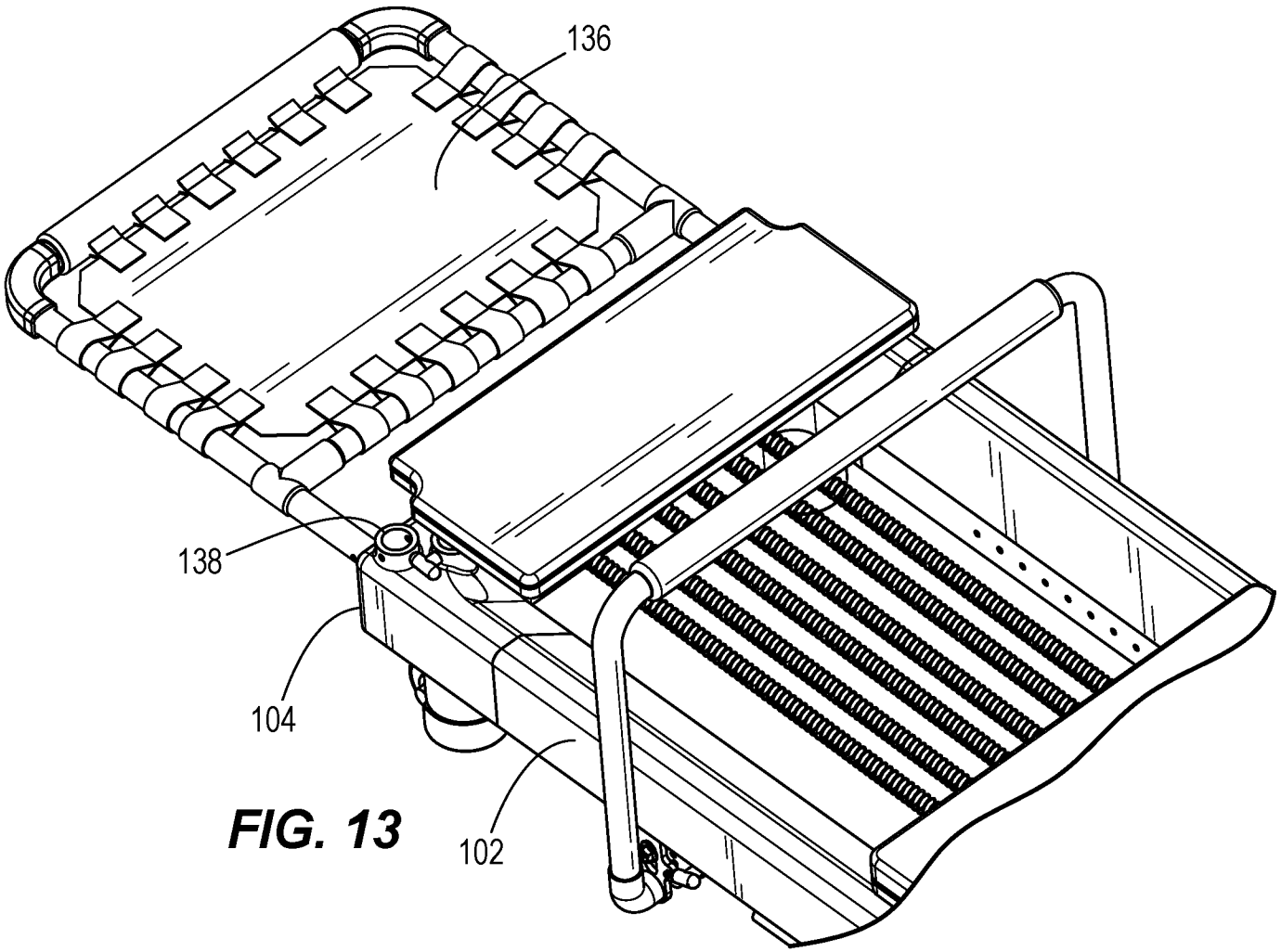
FIG. 13 is a partial perspective view of the exercise machine with the trampoline pad in a different orientation relative to the frame.

As shown in FIGS. 9 and 13, at the front end 104 of the exercise machine 100, a trampoline pad 136 is attached to the frame 102. The trampoline pad 136 has a first position wherein it is in a generally vertical position to act as a rebounder for exercises where a user's foot or feet push off the trampoline pad 136 as shown in FIG. 9. The trampoline pad 136 has a second position wherein it is in a generally horizontal position to act as a trampoline for a cardio-type workout as shown in FIG. 13. Preferably, the trampoline pad 136 pivots using a pivoting mechanism 138 between its first position and its second position, however, it should be noted that other types of motion can also be utilized.

As shown in FIG. 9, a horizontal platform 140 is positioned near the trampoline pad 136 at the front end 104 and is supported by the frame 102. The platform 140 is particularly suited for a user to perform standing leg exercises with one or both feet on the platform 140. The platform 140 is removable from the frame 102 via a lifting motion to gain access to the springs 116 if needed.

Figure 14:
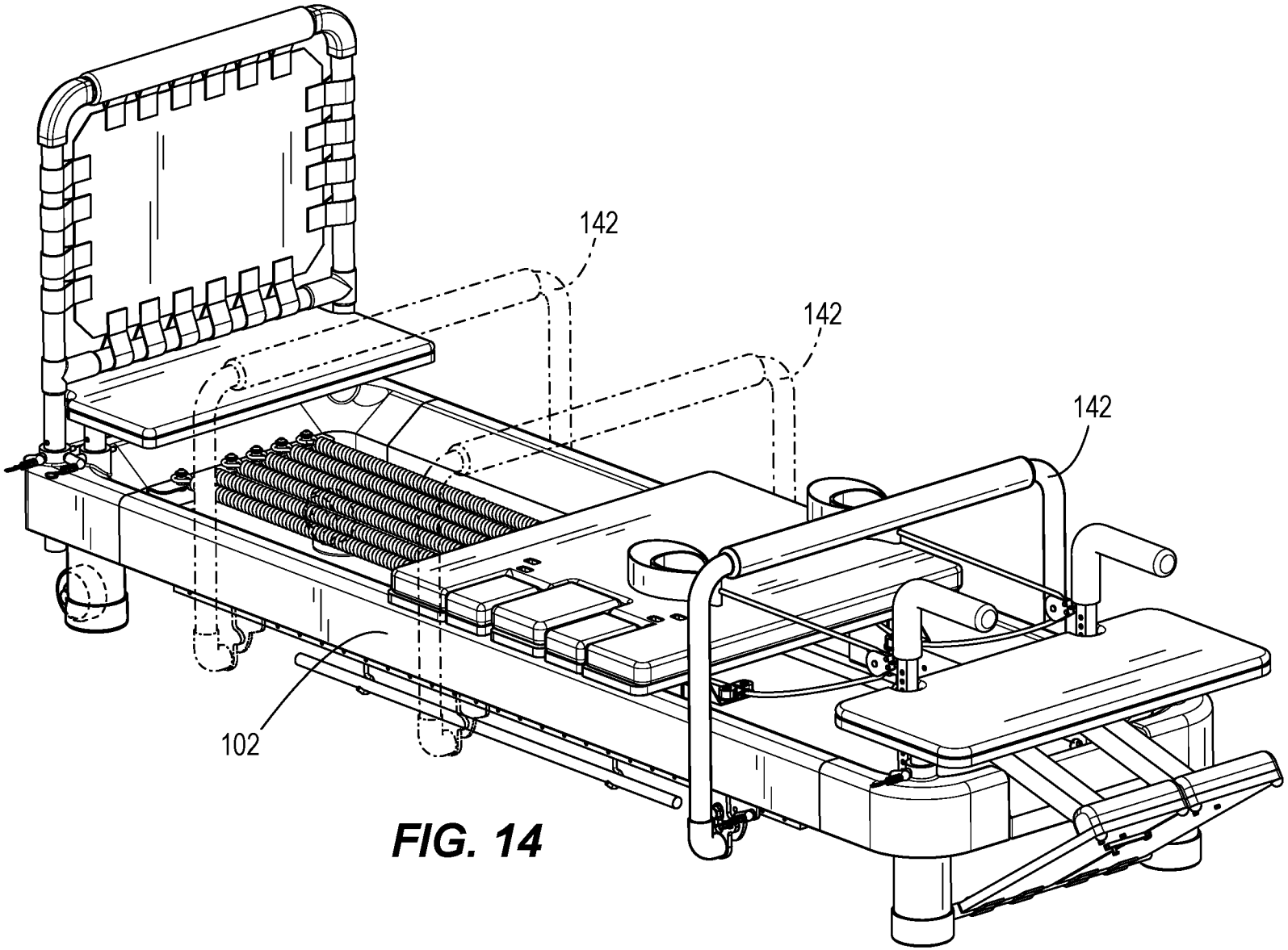
FIG. 14 is a perspective view of the exercise machine showing the foot bar in differing locations relative to the frame.

Turning to FIGS. 9 and 14, a foot bar 142 is removably fastened to the frame 102 to provide user support during various exercises. The foot bar 142 is repositionable at multiple points along the frame 102 for more versatile use. As shown in FIG. 14, the foot bar 142 can be detached from the frame 102 at one position and moved to a different position along the frame 102 as shown in phantom in FIG. 14. Preferably, a locking mechanism (not shown) holds the foot bar 142 in place at a selected location, however, it should be noted that other retention mechanisms can also be utilized.

Figure 15:
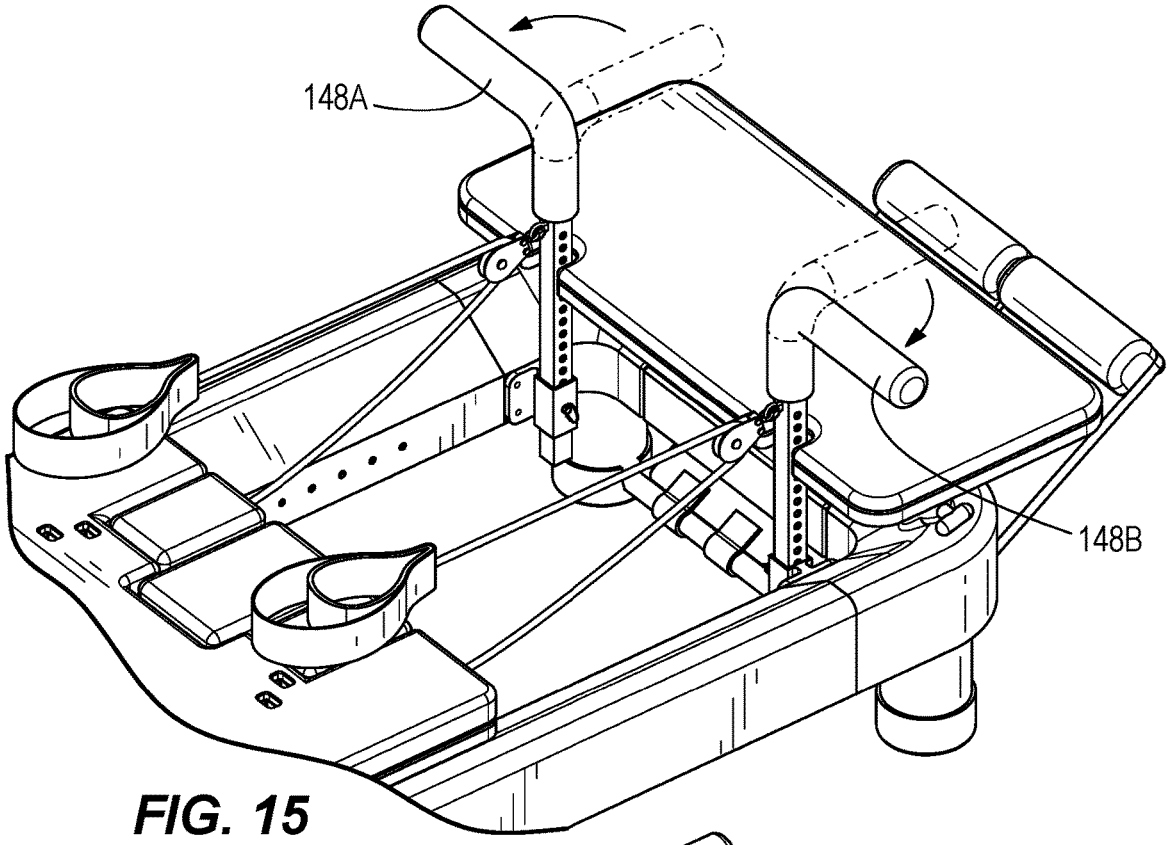
FIG. 15 is a partial perspective view showing the handle bars in differing orientations relative to the frame.

As shown in FIG. 9, the exercise machine 100 includes a chair 144 and a split foot pedal 146 as are known in the art. Adjacent the chair 144 is a pair of handle bars 148A and 148B. The handle bars 148A and 148B are secured to the frame 102 and are rotatable through 360 degrees of motion to allow a user to grip the handle bars 148A and 148B in multiple positions such as palms in or palms out relative to a user's body. FIG. 15 shows the handle bars 148A and 148B is various other positions than that shown in FIG. 9. The handle bars 148A and 148B are removable from the exercise machine 100.

Figure 16:
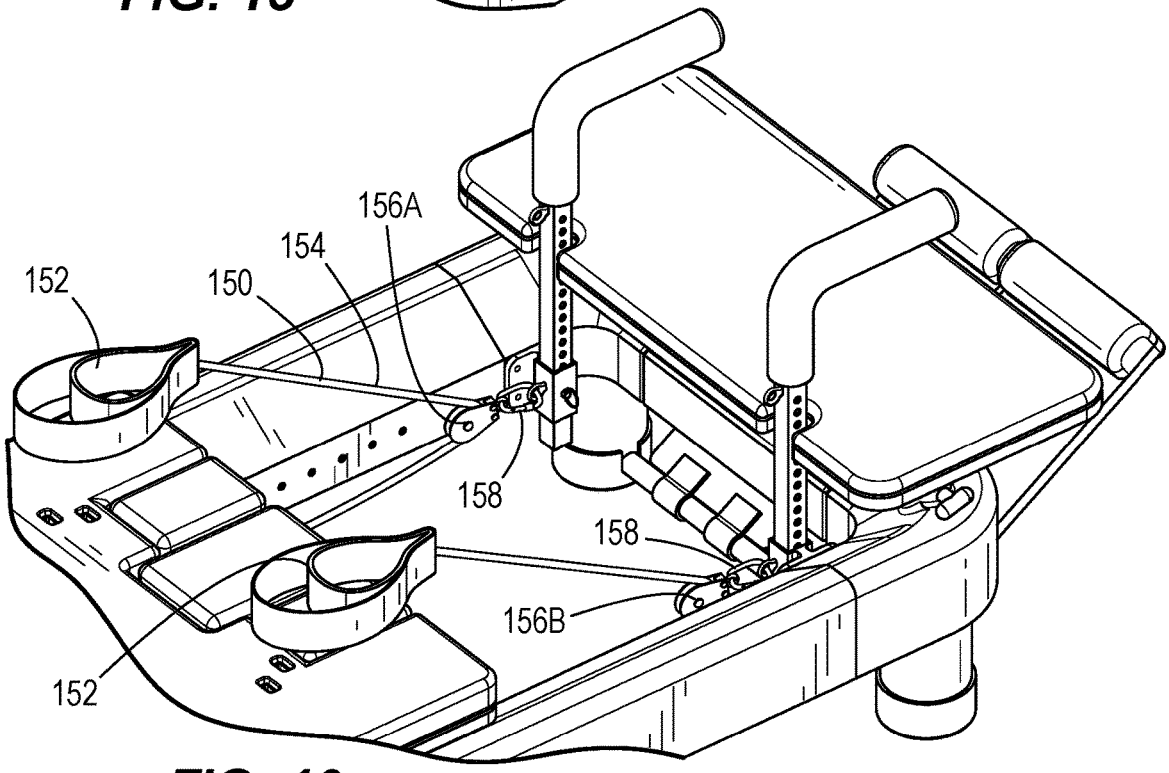
FIG. 16 is a partial perspective view of the exercise machine showing the pulleys attached to the frame.

As shown in FIGS. 9 and 16, a pulley system 150 having handles 152, a cable 154 and pulleys 156 is shown in a first position in FIG. 9 where the pulley 156A and 156B is secured to a handle bar 148A and 148B. The pulley system 150 has a second position as shown in FIG. 16 wherein the pulley 156A and 156B is attached to the frame 102 at a position lower than the first position. The pulley can be attached to the handle bar 148A and 148B and/or frame 102 via a connector such as a carabiner 158, however, it should be note that other types of connectors can also be utilized.

Figure 17:
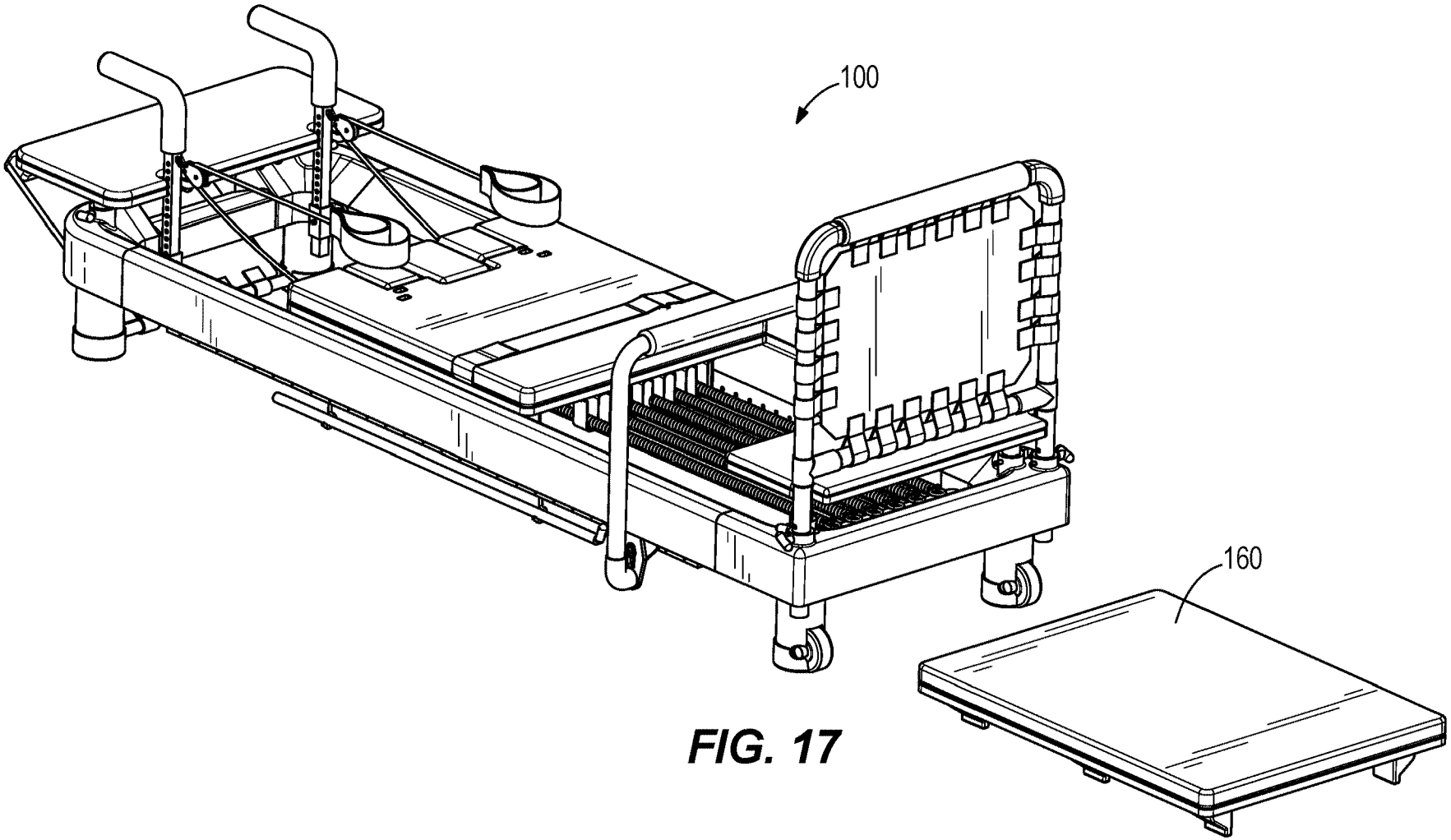
FIG. 17 is a perspective view of the exercise machine with the mat conversion pad on the floor.
Figure 18:
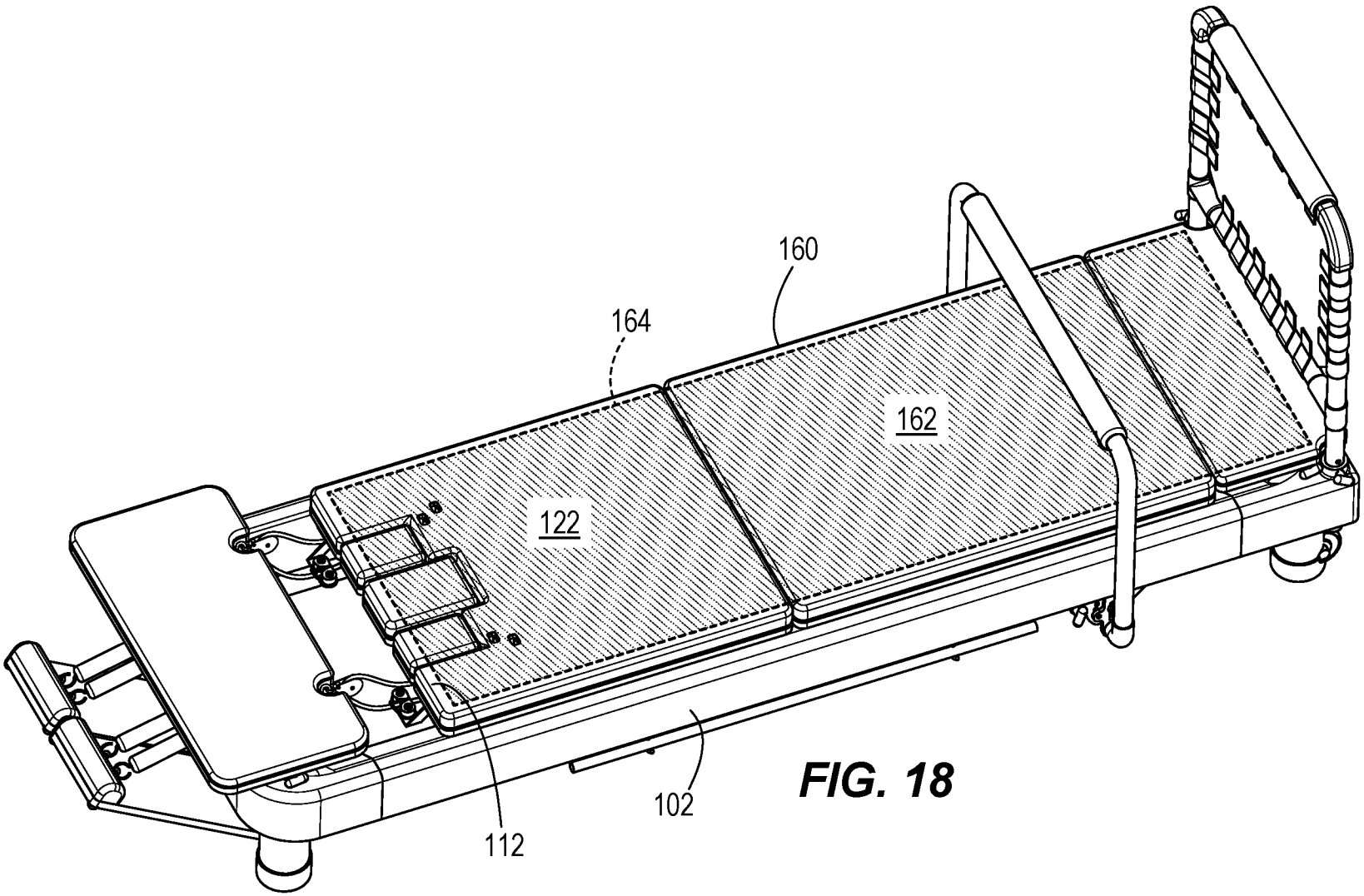
FIG. 18 is a perspective view of the exercise machine with the mat conversion pad positioned on the exercise machine.

As shown in FIGS. 9, 17 and 18, the exercise machine 100 optionally includes a mat conversion pad 160. The mat conversion pad 160 is generally rectangular and can also be utilized by a user when it is separated from the exercise machine 100 as shown in FIGS. 9 and 17. As shown in FIG. 18, the mat conversion pad 160 is removably positionable on the frame 102 preferably adjacent the carriage 112. The mat conversion pad 160 is removable from the exercise machine 100 to allow the carriage 112 to slide freely on the rails 108A and 108B. The mat conversion pad 160 preferably has a planar top surface 162 to support a user. To create a unified larger mat area 164 (shown in shading) for a user to utilize for resting or exercising, the mat conversion mat 160 is positioned on the frame 102, the handle bars 148A and 148B are removed, the head rest 124 is in its stowed position, the shoulder rests 126 are in their stowed position and the pulley system 150 is stored under the carriage 112. This creates the unified generally planar area 164 of the top surfaces 122, 162 of the carriage 112 and the mat conversion pad 160, respectively, that is available to the user for exercising, stretching or resting.

Various features and advantages of the invention are set forth in the following claims.

What is claimed is:

1. A pilates reformer for a user comprising:

a frame having rails defining a longitudinal axis; and a carriage rotatably connected to the frame and dimensioned to support the user in a lying position, the carriage being slidably moveable by the user along the longitudinal axis of the rails, wherein:

the carriage is moveable by the user along the longitudinal axis of the rails in a first position, wherein in the first position a longitudinal axis of the carriage is parallel to the longitudinal axis of the rails, such that the carriage is aligned with the rails; and the carriage is rotatably repositionable by the user to a second position on the frame, wherein in the second position the longitudinal axis of the carriage is nonparallel to the longitudinal axis of the rails, such that the carriage extends beyond the rails; and the carriage is configured to be locked in the second position.

2. The pilates reformer of claim 1 and further including a pulley and a handle bar, the pulley having a first position attached to the handle bar and a second position attached to the frame.

3. The pilates reformer of claim 2 and further including a mat conversion pad removably positionable on the frame and having a generally planar top surface adjacent to a top surface of the carriage.

4. The pilates reformer of claim 1 where the longitudinal axis of the carriage in the second position is perpendicular to the longitudinal axis of the rails.

5. The pilates reformer of claim 1 and further including a trampoline pad moveable between a vertical position substantially above the frame and a horizontal position extending substantially outwardly from the frame.

6. The pilates reformer of claim 1 and further including a foot bar moveable and securely positionable along a plurality of positions along the frame.

7. The pilates reformer of claim 1 and further including a pair of handle bars that are rotatable through 360 degrees of motion.

8. The pilates reformer of claim 1 wherein the carriage includes a head rest and a shoulder rest that are movable to a stowed position on the carriage such that an entire top surface of the carriage is generally planar.

* * * * *